US005771726A

United States Patent [19]

Bibby et al.

[11] Patent Number: 5,771,726

[45] Date of Patent: Jun. 30, 1998

[54] APPARATUS AND METHOD FOR TWISTING HOLLOW RODS

[75] Inventors: Keith M. Bibby, Mansfield, Mass.; Robert H. Hesford, Sr., North Kingstown, R.I.; John Surrette, Warwick, R.I.; Richard A. Ross, Cranston, R.I.

[73] Assignee: Kenney Manufacturing Company, Warwick, R.I.

[21] Appl. No.: 704,845

[22] Filed: Aug. 28, 1996

[51] Int. Cl.[6] ..... B21D 11/14

[52] U.S. Cl. ..... 72/20.2; 72/14.8; 72/299; 29/507

[58] Field of Search ..... 72/299, 20.2, 14.8, 72/371; 29/507, 508, 434

[56] References Cited

U.S. PATENT DOCUMENTS

| | | | |
|---|---|---|---|
| Re. 24,783 | 2/1960 | Humphrey . | |
| 1,826,077 | 10/1931 | Johnson . | |
| 2,881,517 | 4/1959 | Carpenter et al. . | |
| 2,902,080 | 9/1959 | Fuchs, Jr. et al. . | |
| 3,015,355 | 1/1962 | Humphrey . | |
| 3,267,714 | 8/1966 | Phillips . | |
| 3,533,267 | 10/1970 | Bunnell . | |
| 4,019,356 | 4/1977 | Bohl . | |
| 4,059,004 | 11/1977 | Perkins . | |
| 4,317,353 | 3/1982 | Geppelt et al. . | |
| 4,437,329 | 3/1984 | Geppelt et al. . | |
| 4,503,694 | 3/1985 | Takumi | 72/131 |
| 4,555,924 | 12/1985 | Remy | 72/307 |
| 4,757,702 | 7/1988 | Theilacker et al. . | |
| 5,410,808 | 5/1995 | Geppelt | 29/507 |

FOREIGN PATENT DOCUMENTS 1 365 039 8/1974 United Kingdom .

*Primary Examiner*—Daniel C. Crane
*Attorney, Agent, or Firm*—Fish & Neave; Richard A. Inz; Garry J. Tuma

[57] ABSTRACT

Apparatus and methods for uniformly twisting hollow, open-seam rods with preferably rectangular cross-sections for use as decorative curtain rods are disclosed. The twist extends throughout substantially the entire length of the rod. This feature enables a telescoped pair of rods, that is, a pair of rods with an inner rod dimensioned to slide into and out of an outer rod, to be twisted simultaneously such that the telescoping feature is maintained after twisting. The apparatus includes a rotatable first chuck and a substantially non-rotatable second chuck. Each chuck has male and female components to engage the inner and outer surfaces of a respective end of the rod. These components prevent buckling along the open seam and permit twisting throughout substantially the entire length of the rods. Sensor controls ensure uniform twisting and controlled unwinding of the rods. The controls are programmable to vary the amount of twist performed on each rod, and the apparatus is adjustable to accommodate rods of different lengths. In addition, rods with other cross-sections can be twisted.

43 Claims, 6 Drawing Sheets

700
716
718
720
722
723B
723A
724
726
410
728
730
732
202
714
710
712
702
708
704
706

APPARATUS AND METHOD FOR TWISTING HOLLOW RODS

BACKGROUND OF THE INVENTION

This invention relates to apparatus and methods for twisting hollow rods. More particularly, this invention relates to apparatus and methods for uniformly twisting a "telescoped" pair of hollow, open-seam rods with a preferably rectangular cross-section. A telescoped pair of rods has an inner rod dimensioned to slide into and out of an outer rod.

The market for home decorating products is becoming more competitive, with larger retail centers and more and more products to choose from. The need for unique, practical, and aesthetically pleasing new products therefore becomes increasingly important. To be viable, these new products should be reasonably and competitively priced and thus must be economically manufactured.

One such new product is a lightweight, sturdy, uniformly twisted curtain rod with a rectangular cross-section. This product is unique because of its telescoping feature; the inner rod can be slid into and out of the outer rod despite its twisted shape. This feature allows the length of the rod to be adjusted so it can be used with windows of various sizes. Furthermore, the twisted appearance of the rod is aesthetically pleasing, and the rod's lightweight, sturdy structure makes it suitable for a variety of home and office decorating projects. However, apparatus and methods for economically mass producing such a product are unknown.

For example, the method and apparatus of U.S. Pat. No. 1,826,077 is limited to twisting welded metal tubes with circular cross-sections. The disclosed apparatus changes the direction of a drawn metal tube's grain from straight to spiral so the tube can be used in the construction of a wind instrument. Moreover, it uses a series of mandrels to support the tube during twisting. Mandrels are cylindrical axles or spindles inserted inside the tube before twisting and then removed after twisting. The insertion and removal of mandrels undesirably increases the amount of time needed to twist each tube, and thus increases manufacturing costs.

Similarly, U.S. Pat. No. RE. 24,783 also discloses a method and apparatus limited to twisting tubes with circular cross-sections. The disclosed system has the further disadvantage of deforming an end of the tube with indentations or "dimples" to facilitate twisting. This deformation is undesirable in products where aesthetics are important.

Other apparatus, such as, for example, U.S. Pat. No. 2,881,517, use a rotating die to roll grooves into the surface of a rounded tube to form circumferentially helical flutes. This structure is similar in appearance to twisted tubes. But, this type of apparatus could not be used to produce telescoped pairs of rods because the grooves rolled into the surface would prevent the inner tube from telescoping.

U.S. Pat. Nos. 3,267,714 and 4,019,356 both disclose apparatus for twisting solid metal workpieces such as iron bars and flats (i.e., rectangularly shaped workpieces). Such apparatus could not be used for twisting hollow tubes or rods because the structural characteristics of solid core workpieces require the apparatus to apply clamping and twisting forces that would likely cause a hollow tube or rod to collapse during twisting. In addition, operation of the apparatus disclosed in the '714 patent could be hazardous because the machine continues running while the operator inserts the workpiece.

The apparatus of U.S. Pat. No. 2,902,080 can purportedly twist hollow, rectangular wave guides. However, the entire length of the wave guide is not twisted; the end portions remain untwisted. Therefore, this apparatus also could not be used to twist a telescoped pair of rectangular rods; the untwisted ends prevent the inner rod from telescoping. Furthermore, the untwisted ends disrupt the aesthetic appearance of the rod.

In fact, many known twisting machines cannot twist the entire length of a rod because of the way the ends typically are held. Thus, telescoped pairs of twisted rods cannot be produced, undesirably forcing a supplier to produce, and a retailer to maintain, a large inventory of various fixed-length twisted curtain rods.

Also, many known methods and apparatus perform twisting on welded or extruded tubes. These tubes are more expensive than tubes or rods with unwelded or open seams, because welded and extruded tubes undergo a more involved manufacturing process. It is therefore more cost effective and preferable to use tubes or rods with open seams.

Unfortunately, open-seam rods usually are more difficult to twist. Buckling along the open seam is common because of the lack of resistance against each side of the open seam during twisting, thus making it difficult to maintain the cross-sectional shape of the rod. Further, the rod's "springback," that is, the tendency of the rod to suddenly and partially return to its original untwisted shape upon release from the twisting apparatus, is greater for open-seam rods than for welded-seam rods. The greater springback is caused by the greater elasticity of the open-seam rod. Thus, additional safeguards and controls are required to prevent injury to the operator and damage to the rod.

Therefore, it would be desirable to provide apparatus and methods for uniformly twisting a telescoped pair of hollow, open-seam rods with a preferably rectangular cross-section. The twist is performed throughout substantially the entire length of the rod pair, thus enabling the telescoping feature to be maintained after twisting.

It would also be desirable to be able to provide apparatus and methods that can perform precise amounts of twist on a rod pair and that can accommodate different lengths of rod pairs.

It would further be desirable to provide apparatus and methods that can controllably relieve the springback in an open-seam twisted rod pair.

It would still further be desirable to provide apparatus and methods that can be easily operated and safely performed and that can produce high volumes of quality product.

SUMMARY OF THE INVENTION

It is an object of this invention to provide apparatus and methods for uniformly twisting a telescoped pair of hollow, open-seam rods with a preferably rectangular cross-section. The twist is performed throughout substantially the entire length of the rod pair, thus enabling the telescoping feature to be maintained after twisting.

It is also an object of this invention to provide apparatus and methods that can perform precise amounts of twist on a rod pair and that can accommodate different lengths of rod pairs.

It is a further object of this invention to provide apparatus and methods that can controllably relieve the springback in an open-seam twisted rod pair.

It is still a further object of this invention to provide apparatus and methods that can be easily operated and safely performed and that can produce high volumes of quality product.

In accordance with this invention, there is provided apparatus for uniformly twisting a hollow, open-seam rod pair peripherally about the rod pair's longitudinal axis. The twist is performed throughout substantially the entire length of the rod pair. The apparatus is driven, for example, by a stepper motor connected to a gear head. The gear head is connected to a rotatable first chuck that engages one end of the rod pair. A substantially non-rotatable second chuck, in alignment with the first chuck, engages the other end of the rod pair and is fixedly attached to a linear thruster. The linear thruster is mounted on a fixture plate for reciprocating motion between a first position and a second position in alignment with the first and second chucks.

When the twist cycle begins, the linear thruster drives the second chuck from the first position to the second position, causing one end of the rod pair to be inserted into the first chuck and the other end to be inserted into the second chuck. Each chuck has male and female components for engaging the inner and outer surfaces of a respective end of the rod pair. This manner of engaging the ends prevents buckling along the rod pair's open seam during twisting. Upon completion of the twist, the linear thruster returns to the first position, disengaging the rod pair from the chucks.

Apparatus and methods for automatically performing a precise amount of twist and for relieving a twisted rod pair's springback are also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

The present invention provides apparatus and methods for twisting hollow, telescoped pairs of open-seam rods. First and second chucks are each designed with male and female components to engage the inner and outer surfaces of a respective end of a telescoped rod pair. By engaging the ends of a rod pair in this manner, twisting can be performed throughout substantially the entire length of the rod pair without either the rod pair buckling along the open seam or the ends of the rod pair deforming from the stress of twisting. After twisting, the telescoping function of the twisted rod pair is maintained. Note that the present invention can also be used to twist individual hollow rods with or without open-seams.

Precise twisting is preferably achieved with automatic controls that deactivate the stepper motor when the amount of twist performed on a rod pair substantially equals a pre-set amount. Automatic controls also preferably direct the stepper motor to controllably relieve (i.e., unwind) the twisted rod pair's springback.

Springback is the recoil, or release of stored elastic energy, which is a portion of the energy expended to twist the rod pair, that causes the twisted rod to suddenly and partially unwind after twisting (similar to the release of a flexed leaf spring). Springback is greater in an open-seam rod than in a welded-seam rod because the elasticity of an open-seam rod is greater. Thus, it is preferable to relieve springback in a controlled manner to avoid injury to the operator and damage to the rod.

Figure 1:
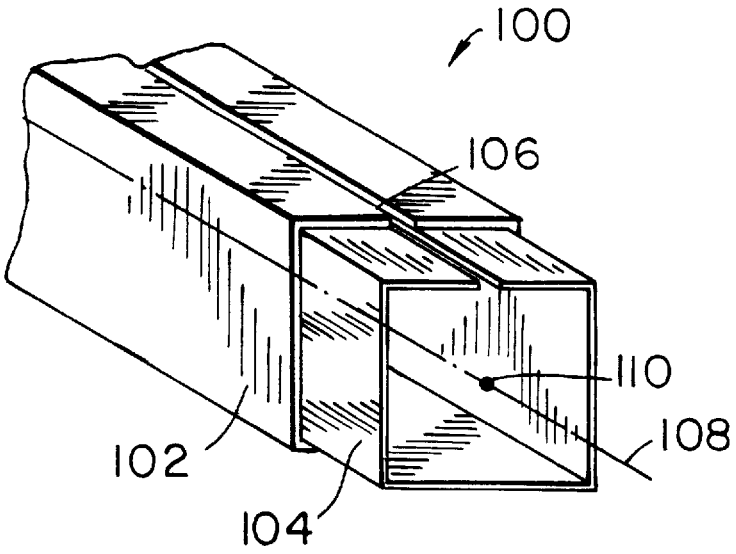
FIG. 1 is a perspective view of a portion of an untwisted telescoped pair of hollow, open-seam rods.

FIG. 1 illustrates telescoped rod pair 100, which is hollow and includes outer rod 102 and inner rod 104. Inner rod 104 is dimensioned to frictionally slide into and out of outer rod 102, and is slightly longer than outer rod 102 to facilitate its grasp for varying the overall length of rod pair 100. Rod pair 100 has an unwelded or open seam 106 and a preferably rectangular cross-section. A longitudinal axis 108 runs parallel to the rod pair's length through the cross-sectional center 110. Rod pair 100 is fabricated from preferably sheet metal or aluminum, and is lightweight, sturdy, and relatively economical to manufacture. The open-seam avoids the cost of welding, and as such, the material may be obtained either pre-painted or pre-coated. Other materials suitable for twisting may also be used.

Figure 2A:
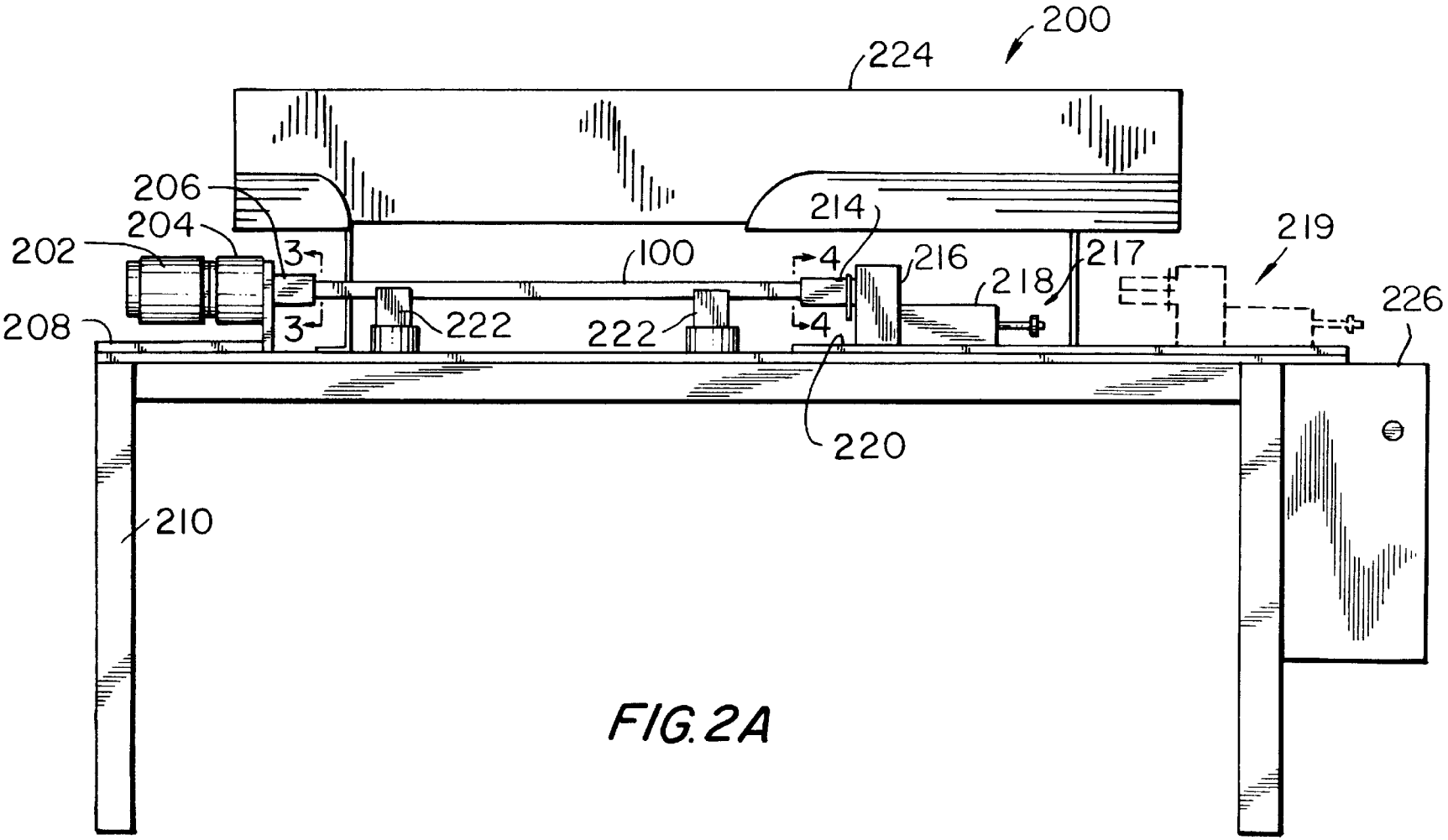
FIGS. 2A and 2B are front and plan views, respectively, of a preferred embodiment of an apparatus for twisting hollow, open-seam rods.
Figure 2B:
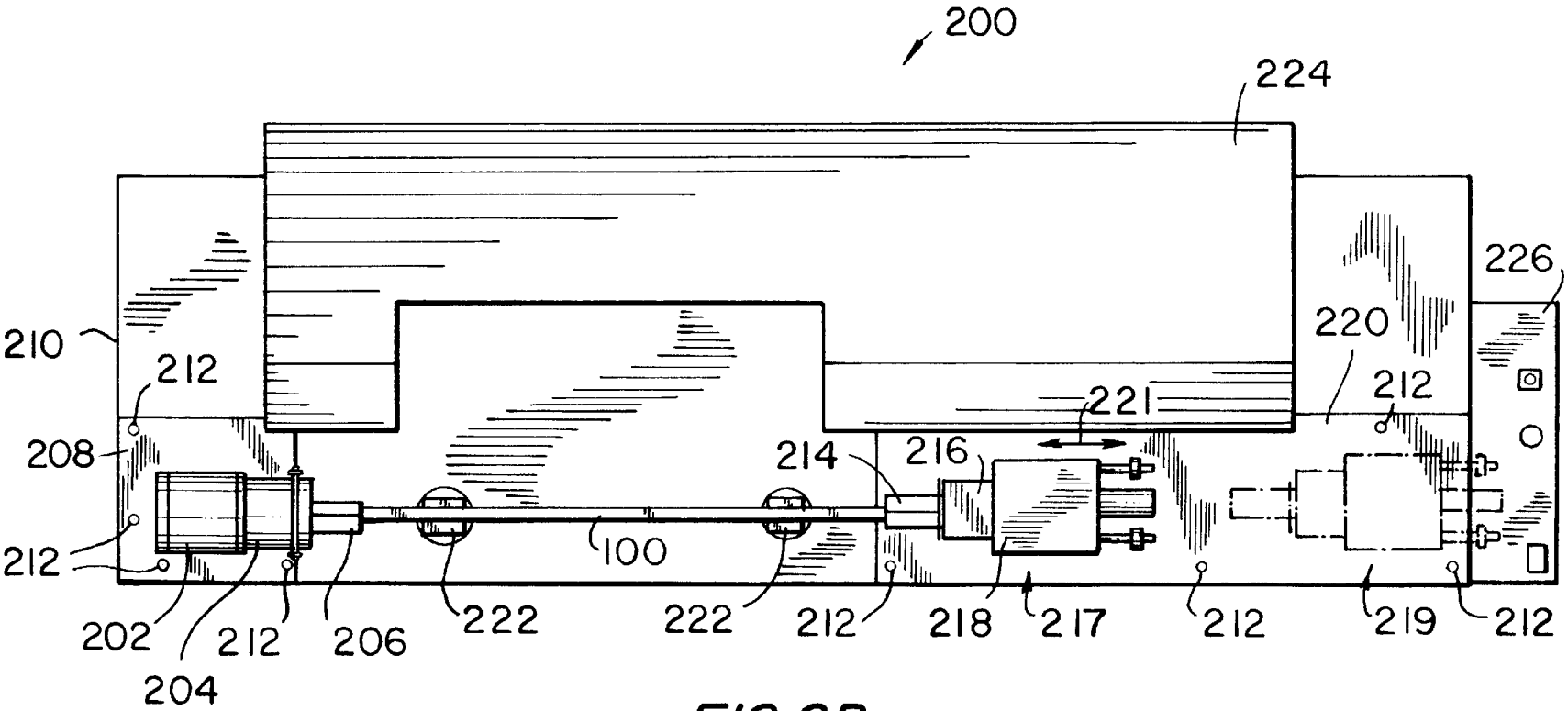

A preferred embodiment of an apparatus for twisting rod pair 100, or an individual hollow rod, is shown in FIGS. 2A and 2B. It should be noted that the present invention can also twist a telescoped rod with more than one inner rod and still maintain the telescoped rod's telescoping feature. Apparatus 200 is preferably driven by stepper motor 202, which is preferably a SIGMAX® MTDE31 Series motor, Model No. MTDE31NX-LTLXX-XX50, by Pacific Scientific, Charlestown, Mass. Apparatus 200 could alternatively be driven by other types of motors and drivers such as, for example, a DC servo motor, such as Pacific Scientific Model No. R23HENAR1NSNV01, or an AC inverter drive system or one of various fluid power systems.

Stepper motor 202 is directly mounted to gear head 204 and secured thereto with nuts and bolts. Gear head 204 is connected to rotatable first chuck 206, and is preferably a Bayside NEMA Gearhead, Model No. NE 34, by Bayside Controls Inc, Port Washington, N.Y. Alternatively, a combination motor/gearbox, such as a Model No. S6M4H/GH6-20 by PMI Motion Technologies, Commack, N.Y., could be used instead of stepper motor 202 and gear head 204.

The assembly of stepper motor 202, gear head 204, and first chuck 206 is mounted, preferably, on L-shaped motor plate 208. Motor plate 208 is preferably mounted on workbench 210, or other appropriate structure, to prevent relative motion thereof. Conventional fasteners such as nuts and bolts 212 can be used to secure both the motor assembly to motor plate 208 and motor plate 208 to workbench 210.

Apparatus 200 also includes second chuck 214, which is substantially non-rotatable and longitudinally aligned with first chuck 206. When rod pair 100 is properly loaded in apparatus 200, an axis between first chuck 206 and second chuck 214 is collinear with longitudinal axis 108 of rod pair 100. Second chuck 214 is preferably connected to fixture block 216, which in turn is connected to linear thruster 218. Linear thruster 218 is preferably mounted on fixture plate 220 to stabilize the base of the thruster. Fixture plate 220 is mounted on workbench 210. Note that linear thruster 218 could alternatively be mounted directly to workbench 210 or some other stable surface or structure.

Linear thruster 218 is a device that provides controlled linear reciprocating motion, as shown by double-headed arrow 221 in FIG. 2B, between two points that are determined by the stroke of the thruster. A number of commercially available units may be used. For example, an HRCS series, Model No. 22120003 with a 3-inch stroke, available from Tol-O-Matic, Minneapolis, Minn., can be used.

Initially, linear thruster 218 is at a first position, which is a short distance away from an end of rod pair 100. While linear thruster 218 is at the first position, apparatus 200 can be loaded and unloaded. When the twist cycle is activated, linear thruster 218 moves to a second position, enabling first and second chucks 206 and 214 to engage the ends of rod pair 100. Upon completion of the twist, linear thruster 218 returns to the first position.

The assembly of second chuck 214, fixture block 216, and linear thruster 218 is positioned a distance from first chuck 206 somewhat greater than the length of rod pair 100 to accommodate the reciprocating motion of linear thruster 218. The second chuck assembly can be re-positioned along the longitudinal axis between first and second chucks 206 and 214, as shown, for example, by positions 217 and 219 (FIGS. 2A and 2B), to accommodate rods of different lengths.

Preferably, a plurality of rod holders 222, located between first and second chucks 206 and 214, support rod pair 100 before twisting. Rod holders 222 may be stationary fixtures such that placement of rod pair 100 upon rod holders 222 automatically longitudinally aligns rod pair 100 with first and second chucks 206 and 214, or, as in the preferred embodiment, rod holders 222 have a preferably lower position for loading and unloading, and a preferably upper position for longitudinally aligning rod pair 100 with first and second chucks 206 and 214 when the twist cycle begins.

Figure 3:
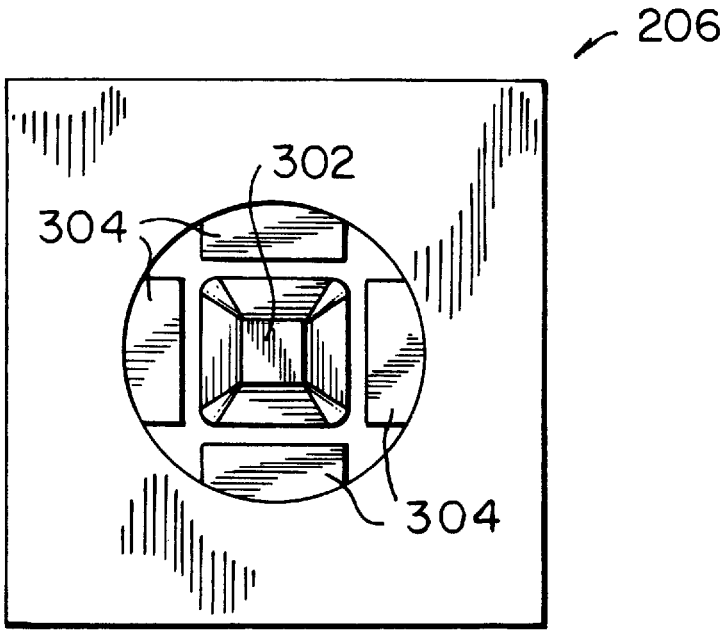
FIG. 3 is a front view of a first chuck taken from line 3—3 of FIG. 2A.

First chuck 206, as shown in FIG. 3, includes male component 302 and female components 304. Male component 302 has beveled edges and is dimensioned and shaped to fit precisely within the contours of the inside surfaces of an end of rod pair 100. Male component 302, in cooperation with female components 304, supports the cross-sectional shape of rod pair 100 during twisting.

Female components 304 are dimensioned to engage each outside surface of rod pair 100. When apparatus 200 is activated, female components 304 are disposed about the outside surfaces of rod pair 100. Preferably, there is minimal tolerance between the rod pair's surfaces and the male and female components. By engaging the end of rod pair 100 in this manner, the ends are securely supported during twisting, and damage to the end of the rod and buckling along the open seam are therefore prevented.

Figure 4:
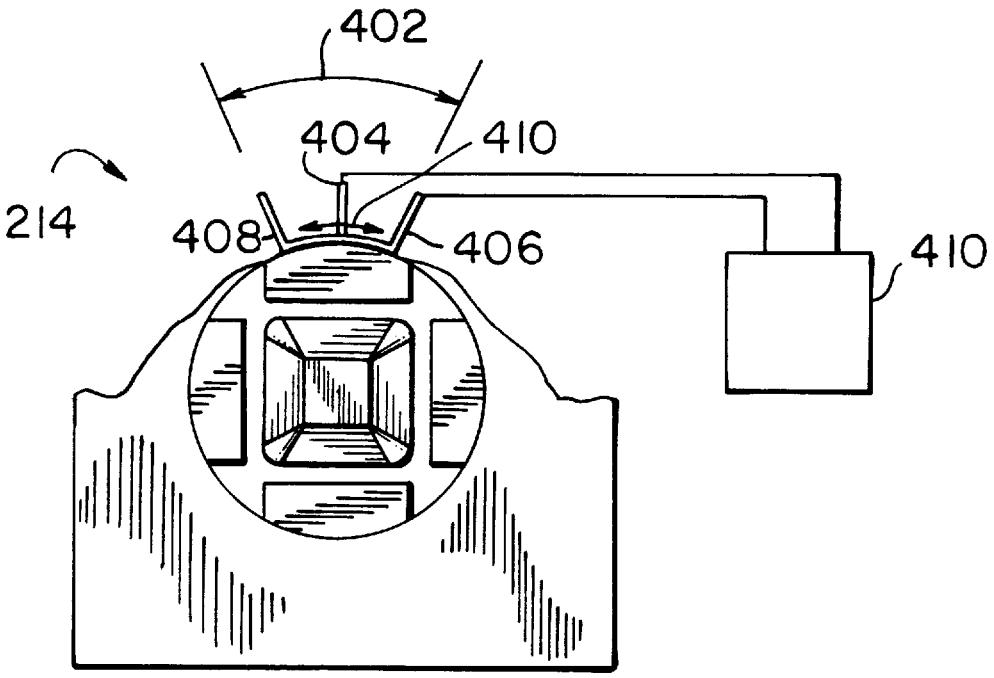
FIG. 4 is a representational front view of a second chuck taken from line 4—4 of FIG. 2A.

FIG. 4 illustrates second chuck 214 taken from line 4—4 of FIG. 2A. Second chuck 214 is mounted on a ball bearing (not shown) and is allowed to rotate slightly, as shown by double-headed arrow 402, preferably about 10 degrees. Chuck pin 404 is fixedly attached to second chuck 214 and moves between stop pins 406 and 408, as shown by double-headed arrow 410. Stop pins 406 and 408 are fixedly attached to the frame of second chuck 214. Chuck pin 404 and stop pin 406 form a proximity switch electrically connected to proximity sensor 410. When a rod or rod pair is being twisted, second chuck 214 rotates slightly in conjunction with the rotational movement and direction of first chuck 206, forcing chuck pin 404 against stop pin 406. This movement closes the switch activating proximity sensor 410. When the rod or rod pair is unwound, chuck pin 404 moves away from stop pin 406, opening the switch, indicating to proximity sensor 410 that the rod or rod pair is now unwound and that the next part of the twist cycle, described further below, can begin. Note that the direction of twisting and the particular stop pin used as the second switch contact may be reversed from that shown in FIG. 4. That is, the twisting rotational direction could be counter-clockwise and stop pin 408 could be used instead of stop pin 406.

Figure 5:
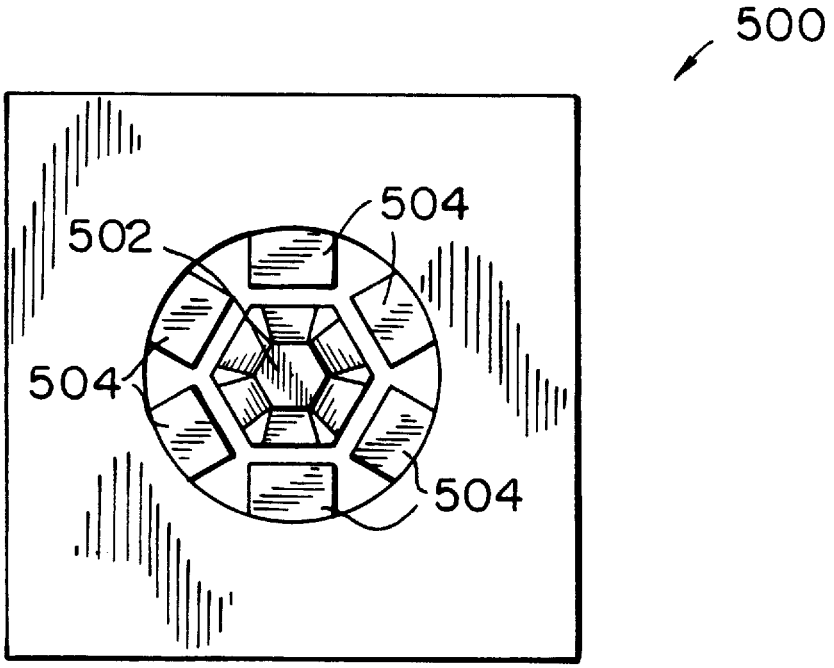
FIG. 5 is a front view of an alternative chuck for engaging a rod with a different cross-sectional shape, taken from line 3—3 of FIG. 2A.

Rods of other dimensions, shapes, and cross-sections, such as, for example, fluted or hexagonal, could also be twisted by the present invention. To twist these other rods, first and second chucks 206 and 214 can be replaced with chucks having male and female components appropriately dimensioned and shaped to accommodate the particular rod to be twisted. FIG. 5 illustrates alternative chuck 500 with male component 502 and female components 504 for engaging a rod with a hexagonal cross-section.

Figure 6:
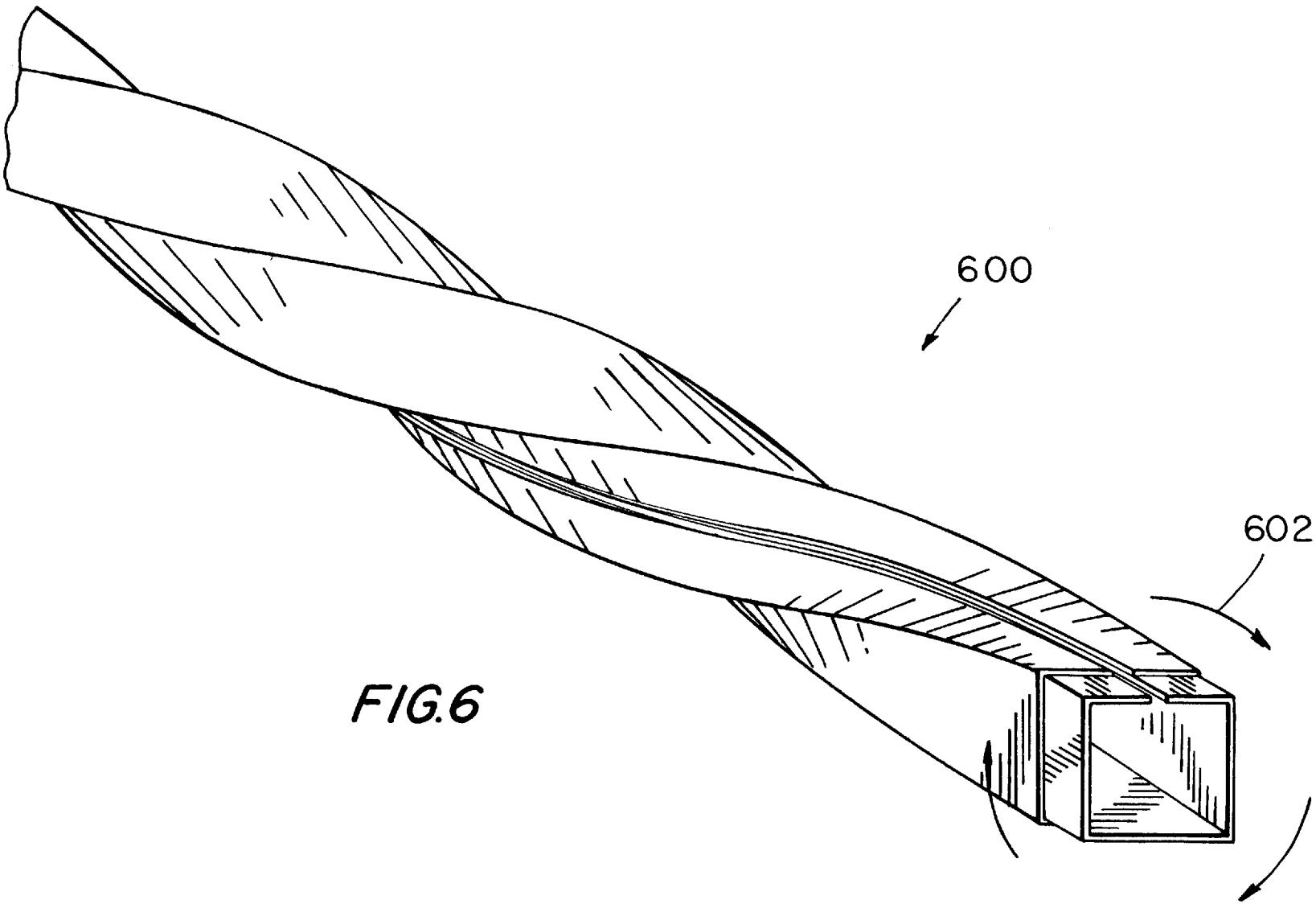
FIG. 6 is a perspective view of a portion of a twisted telescoped pair of hollow, open-seam rods.

Once the ends of rod pair 100 are inserted in first and second chucks 206 and 214, twisting of rod pair 100 about its periphery, as shown by directional arrows 602 in FIG. 6, can be performed throughout substantially the entire length. Thus, twisted rod pair 600 has no untwisted portions, which cannot generally be accomplished with known twisting apparatus, and telescoped pairs of rods can therefore be twisted while still maintaining the telescoping feature.

Hopper 224 (FIGS. 2A and 2B) is optionally provided to maintain a supply of untwisted rods and to facilitate loading of apparatus 200. Hopper 224 is preferably positioned above apparatus 200 and mounted to workbench 210 by conventional fastening methods, such as screws. In a preferred embodiment, hopper 224 is constructed of welded stainless sheet metal, but other suitable materials may be used.

Figure 7:
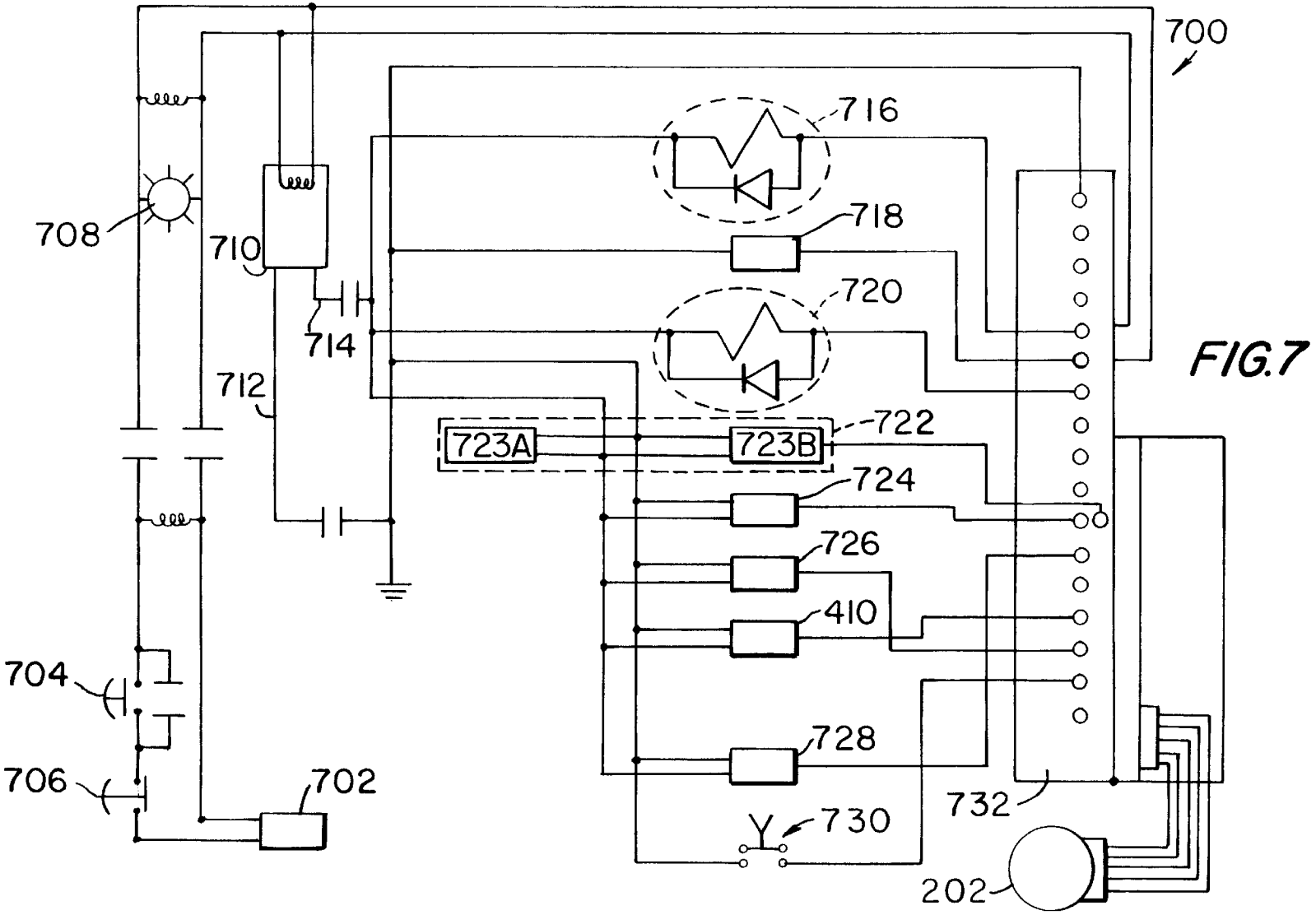
FIG. 7 is a block diagram of the electrical components that control the apparatus of FIGS. 2A and 2B.

Electrical box 226 houses circuitry 700, which includes the power connections for supplying power to apparatus 200 and preferably includes motion control electronics for controlling apparatus 200. Circuitry 700 is illustrated in the block diagram of FIG. 7. AC power 702 is connected to circuitry 700 to supply electrical power to apparatus 200. Activation of push button 704 powers up apparatus 200, which illuminates indicator light 708, and activation of push button 706 powers down apparatus 200.

Circuitry 700 preferably includes DC power supply 710 for providing DC power to the motion control electronics. Electrical conductor 712 provides a negative DC voltage, preferably −24 volts, and conductor 714 provides a positive DC voltage, preferably +24 volts. Alternatively, the motion control electronics could, with modifications known to those of ordinary skill in the art, be powered with AC power.

Circuitry 700 also includes the following components: solenoid valve 716, which controls the position of rod holders 222; production counter 718, which counts each twist cycle, that is, the number of rods or rod pairs twisted, and which can be zeroed by pushing a reset button (not shown); solenoid valve 720, which controls the reciprocating motion of linear thruster 218; home sensor 722, which includes a receiver 723A and an emitter 723B, and which counts the number of signals sent to stepper motor 202 and rotationally aligns first chuck 206, if needed, with the corresponding end of rod pair 100 to ensure that rod pair 100 will be properly inserted in first chuck 206; push button switches 724 and 726, which when pushed and held together, start each twist cycle; proximity sensor 410, which senses the completion of the initial twist and subsequent springback relief based on the opening and closing of the proximity switch (FIG. 4); safety sensor 728, which ensures that rod pair 100 is properly inserted in first and second chucks 206 and 214 before allowing stepper motor 202 to activate; selector switch 730, which selects one of two predetermined amounts of twist to be performed, the predetermined amounts of twist corresponding to the length of the rod or rod pair to be twisted—longer rods requiring more twist than shorter ones; and logic controller 732, which is connected to the aforementioned components and stepper motor 202.

Logic controller 732 provides automated control of apparatus 200, particularly stepper motor 202 and linear thruster 218, and is preferably a programmable, self-contained indexer/driver that includes communications for programming and nonvolatile memory for program storage. The amount of twist and subsequent amount of unwind, explained below, to be performed on a rod or rod pair are preferably programmed and stored in logic controller 732. Preferably, a plurality of such amounts of twist and unwind, corresponding to different rod or rod pair lengths, are stored. Logic controller 732 is preferably a Model 5345 by Pacific Scientific, Charlestown, Mass., or as a substitute, a Model 6410, also by Pacific Scientific, could be used.

The motion control electronics result in the following: uniform twisting throughout substantially the entire length of the rod; consistent twisting from rod to rod; and safe and efficient operation of apparatus 200.

In a preferred embodiment, operation of apparatus 200 is as follows: an operator sets switch 730 to correspond to the length of the rod or rod pair to be twisted, and then loads, for example, rod pair 100, preferably onto rod holders 222. The operator then activates push button switches 724 and 726 to begin the twist cycle. A control signal from programmable logic controller 732 activates solenoid valve 716, which causes rod holders 222 to position rod pair 100 in alignment with first and second chucks 206 and 214. Home sensor 722 then causes, if needed, first chuck 206 to be rotationally aligned with the respective end of rod pair 100 to ensure proper insertion of rod pair 100 in first chuck 206. Logic controller 732 then activates solenoid valve 720. Solenoid valve 720 causes linear thruster 218 to slidably move from the first position to the second position, causing the respective ends of rod pair 100 to be inserted into first and second chucks 206 and 214. Safety sensor 728 ensures that rod pair 100 is properly inserted in first and second chucks 206 and 214 before allowing the twist cycle to continue.

Another control signal from programmable logic controller 732 activates stepper motor 202, which drives gear head 204. Gear head 204 then rotationally drives first chuck 206 in a first direction about longitudinal axis 108 of rod pair 100 while second chuck 214 substantially holds the opposite end of rod pair 100 against the rotation. As second chuck 214 rotates slightly in conjunction with first chuck 206, chuck pin 404 is forced against stop pin 406 (or alternatively stop pin 408 if the twisting rotational direction is reversed), closing the switch to activate proximity sensor 410. Rod pair 100 is then twisted a preset amount. The preset amount of twist is the sum of the desired end-result amount of twist plus a predetermined amount of springback and unwind (thus, rod pair 100 is initially overtwisted somewhat).

Once the preset amount of twist has been performed on rod pair 100, logic controller 732 causes stepper motor 202 to reverse direction. Gear head 204 and first chuck 206 are then driven in an opposite rotational direction to begin a controlled and limited unwind of the twisted rod pair 100 to relieve a first springback. As the springback is relieved, second chuck 214 rotates slightly again in conjunction with first chuck 206, causing chuck pin 404 to move away from stop pin 406, which opens the proximity switch. Proximity sensor 410 senses the opening of the switch and signals the logic controller, which then causes stepper motor 202 to continue a preset amount in the reverse (unwind) direction, preferably about 20% of the initial total twist, to re-set slightly rod pair 100. Resetting the rod pair allows it to telescope more easily.

After the preset amount of unwind has been completed, logic controller 732 causes stepper motor 202 to reverse again, driving gear head 204 and first chuck 206 in the first (twisting) direction, to release a second springback caused by the additional preset unwind of rod pair 100. This second springback release continues until chuck pin 404 again makes contact with stop pin 406, closing the proximity switch a second time, indicating to proximity sensor 410 that the twist cycle is complete.

Upon completion of the twist cycle, logic controller 732 activates solenoid valve 720 to cause linear thruster 218 to slidably return to the first position, disengaging the ends of rod pair 100, which have now become twisted rod pair 600, from first and second chucks 206 and 214. Logic controller 732 then activates solenoid valve 716 causing rod holders 222 to lower twisted rod pair 600. The operator then removes twisted rod pair 600 and loads a fresh untwisted rod or rod pair onto holders 222 to repeat the process.

This process is completed in a matter of seconds, enabling large volumes of twisted rods to be produced in a relatively short period of time. Furthermore, this process is safe; the apparatus is not running during loading or unloading when an operator is likely to be injured.

Thus it is seen that apparatus and methods for twisting hollow, telescoped pairs of open-seam rods are provided. The disclosed apparatus and methods are highly efficient with automated alignment, quick loading and unloading, accurate automatic twist, and automatic relief of springback. One skilled in the art will appreciate that the present invention can be practiced by other than the described embodiments, which are presented for purposes of illustration and not of limitation, and the present invention is limited only by the claims which follow.

What is claimed is:

1. An apparatus for twisting a telescoped pair of hollow, open-seam rods, wherein the rod pair includes an outer rod and an inner rod, the rod pair being dimensioned such that the inner rod slides frictionally into and out of the outer rod, the inner rod having a length slightly greater than the outer rod, the rod pair having a longitudinal axis parallel to the length and cross-sectionally centered within the rod pair and having a first end and a second end longitudinally distal from each other, the rod pair being peripherally twisted by the apparatus about the longitudinal axis throughout substantially the entire length of the rod pair such that the inner rod can still frictionally slide into and out of the outer rod, the apparatus comprising:

a motor;

a gear head connected to the motor;

a rotatable first chuck connected to the gear head for engaging the first end of the rod pair, the first chuck having a male component for engaging the inside of the first end of the rod pair;

a substantially non-rotatable second chuck aligned with the first chuck and positioned a distance from the first chuck in accordance with the length of the rod pair, the second chuck engaging the second end of the rod pair, the second chuck having a male component for engaging the inside of the second end of the rod pair;

and a linear thruster connected to the second chuck for reciprocating motion between a first position and a second position, the motion being in alignment with the first and second chucks to permit loading and unloading of the rod pair and to permit engagement of each chuck with a respective end of the rod pair.

2. The apparatus of claim 1 wherein the motor is a stepper motor.

3. The apparatus of claim 1 wherein the motor is a DC servo motor.

4. The apparatus of claim 1 further comprising a fixture block wherein the second chuck and the linear thruster are connected to the fixture block.

5. The apparatus of claim 1 further comprising a motor plate wherein the gear head and the first chuck are mounted on the motor plate.

6. The apparatus of claim 1 further comprising a motor plate and a support surface wherein:

the gear head and the first chuck are mounted on the motor plate; and the motor plate and the fixture plate are both mounted to the support surface.

7. The apparatus of claim 1 wherein the first and second chucks each include at least one female component for engaging the outside of an end of the rod pair.

8. The apparatus of claim 7 wherein the male component and the at least one female component are dimensioned to engage substantially all of each inside and outside surface of the end of the rod pair.

9. The apparatus of claim 7 wherein the first and second chucks are replaceable with first and second chucks having male and at least one female components of other dimensions for engaging rod pairs of other cross-sectional shapes and sizes.

10. The apparatus of claim 7 wherein the male component and the at least one female component are dimensioned to engage a rod pair with a rectangular cross-section.

11. The apparatus of claim 7 wherein the male component and the at least one female component are dimensioned to engage a rod pair with a hexagonal cross-section.

12. The apparatus of claim 1 further comprising a logic controller connected to the motor for causing the motor to perform a specified amount of twist on the rod pair and to deactivate when the specified amount of twist has been performed.

13. The apparatus of claim 12 further comprising a home sensor connected to the motor and the logic controller, wherein the home sensor causes the first chuck to be rotationally aligned for properly receiving an end of the rod pair.

14. The apparatus of claim 12 wherein the logic controller is programmable.

15. The apparatus of claim 14 wherein the specified amount of twist is programmed and stored in the logic controller.

16. The apparatus of claim 12 wherein, after the rod pair has been twisted and the motor has been deactivated, the logic controller then causes the motor to reverse direction for controllably relieving the springback of the rod pair.

17. The apparatus of claim 1 further comprising controls for automatically controlling the reciprocating motion of the linear thruster.

18. The apparatus of claim 1 wherein the distance between the first and second chucks can be varied to accommodate rod pairs of different lengths.

19. The apparatus of claim 1 further comprising a plurality of rod holders for supporting the rod pair before and after twisting.

20. The apparatus of claim 1 further comprising a hopper for holding a supply of rod pairs to facilitate loading of the apparatus.

21. The apparatus of claim 1 further comprising a fixture plate, the linear thruster being mounted on the fixture plate.

22. The apparatus of claim 1 further comprising controls for automatically inserting the rod pair in the first and second chucks.

23. An apparatus for twisting a telescoped pair of hollow, open-seam rods, wherein the rod pair includes an outer rod and an inner rod, the rod pair being dimensioned such that the inner rod slides frictionally into and out of the outer rod, the inner rod having a length slightly greater than the outer rod, the rod pair having a longitudinal axis parallel to the length and cross-sectionally centered within the rod pair and having a first end and a second end longitudinally distal from each other, the rod pair being peripherally twisted by the apparatus about the longitudinal axis throughout substantially the entire length of the rod pair such that the inner rod can still frictionally slide into and out of the outer rod, the apparatus comprising:

a motor;

a gear head connected to the motor;

a rotatable first chuck connected to the gear head for engaging the first end of the rod pair;

a substantially non-rotatable second chuck aligned with the first chuck and positioned a distance from the first chuck in accordance with the length of the rod pair, the second chuck engaging the second end of the rod pair;

a linear thruster connected to the second chuck for reciprocating motion between a first position and a second position, the motion being in alignment with the first and second chucks to permit loading and unloading of the rod pair and to permit engagement of each chuck with a respective end of the rod pair;

a logic controller connected to the motor for causing the motor to perform a specified amount of twist on the rod pair and to deactivate the motor when the specified amount of twist has been performed; wherein, after the rod pair has been twisted and the motor has been deactivated, the logic controller then causes the motor to reverse direction for controllably relieving the springback of the rod pair; and a proximity sensor for signaling the logic controller when the springback of the rod pair has been relieved.

24. The apparatus of claim 23 wherein the logic controller continues to cause the motor to unwind the rod pair by a second specified amount after being signaled by the proximity sensor that the springback has been relieved.

25. The apparatus of claim 24 wherein the logic controller is programmable and the second specified amount of unwind is programmed and stored in the logic controller.

26. An apparatus for twisting a telescoped pair of hollow, open-seam rods, wherein the rod pair includes an outer rod and an inner rod, the rod pair being dimensioned such that the inner rod slides frictionally into and out of the outer rod, the inner rod having a length slightly greater than the outer rod, the rod pair having a longitudinal axis parallel to the length and cross-sectionally centered within the rod pair and having a first end and a second end longitudinally distal from each other, the rod pair being peripherally twisted by the apparatus about the longitudinal axis throughout substantially the entire length of the rod pair such that the inner rod can still frictionally slide into and out of the outer rod, the apparatus comprising:

a motor;

a gear head connected to the motor;

a rotatable first chuck connected to the gear head for engaging the first end of the rod pair;

a substantially non-rotatable second chuck aligned with the first chuck and positioned a distance from the first chuck in accordance with the length of the rod pair, the second chuck engaging the second end of the rod pair;

a linear thruster connected to the second chuck for reciprocating motion between a first position and a second position, the motion being in alignment with the first and second chucks to permit loading and unloading of the rod pair and to permit engagement of each chuck with a respective end of the rod pair; and controls for automatically aligning the rod pair with the first and second chucks for engagement therewith.

27. An apparatus for twisting a telescoped pair of hollow, open-seam rods, wherein the rod pair includes an outer rod and an inner rod, the rod pair being dimensioned such that the inner rod slides frictionally into and out of the outer rod, the inner rod having a length slightly greater than the outer rod, the rod pair having a longitudinal axis parallel to the length and cross-sectionally centered within the rod pair and having a first end and a second end longitudinally distal from each other, the rod pair being peripherally twisted by the apparatus about the longitudinal axis throughout substantially the entire length of the rod pair such that the inner rod can still frictionally slide into and out of the outer rod, the apparatus comprising:

a motor;

a gear head connected to the motor;

a rotatable first chuck connected to the gear head for engaging the first end of the rod pair;

a substantially non-rotatable second chuck aligned with the first chuck and positioned a distance from the first chuck in accordance with the length of the rod pair, the second chuck engaging the second end of the rod pair; and a linear thruster connected to the second chuck for reciprocating motion between a first position and a second position, the motion being in alignment with the first and second chucks to permit loading and unloading of the rod pair and to permit engagement of each chuck with a respective end of the rod pair;

wherein the second chuck rotates slightly about the longitudinal axis in the rotational direction of the first chuck, the second chuck comprising a proximity switch such that the rotating movement of the second chuck causes the proximity switch to open and close.

28. The apparatus of claim 27 further comprising a proximity sensor, wherein the proximity sensor is connected to the proximity switch for sensing changes in the rotational direction of the second chuck, the proximity sensor then transmitting control signals based on those changes.

29. The apparatus of claim 28 further comprising a logic controller connected to the proximity sensor and the motor, the logic controller controlling the motor and being responsive to the control signals from the proximity sensor.

30. An apparatus for twisting a telescoped pair of hollow, open-seam rods, wherein the rod pair includes an outer rod and an inner rod, the rod pair being dimensioned such that the inner rod slides frictionally into and out of the outer rod, the inner rod having a length slightly greater than the outer rod, the rod pair having a longitudinal axis parallel to the length and cross-sectionally centered within the rod pair and having a first end and a second end longitudinally distal from each other, the rod pair being peripherally twisted by the apparatus about the longitudinal axis throughout substantially the entire length of the rod pair such that the inner rod can still frictionally slide into and out of the outer rod, the apparatus comprising:

a motor;

a gear head connected to the motor;

a rotatable first chuck connected to the gear head for engaging the first end of the rod pair;

a substantially non-rotatable second chuck aligned with the first chuck and positioned a distance from the first chuck in accordance with the length of the rod pair, the second chuck engaging the second end of the rod pair;

a linear thruster connected to the second chuck for reciprocating motion between a first position and a second position, the motion being in alignment with the first and second chucks to permit loading and unloading of the rod pair and to permit engagement of each chuck with a respective end of the rod pair;

a plurality of rod holders for supporting the rod pair before and after twisting: and controls for positioning the rod holders, the rod holders having a first position for loading and unloading the rod pair and a second position for aligning the rod pair with the first and second chucks.

31. An apparatus for twisting a telescoped pair of hollow, open-seam rods, wherein the rod pair includes an outer rod and an inner rod, the rod pair being dimensioned such that the inner rod slides frictionally into and out of the outer rod, the inner rod having a length slightly greater than the outer rod, the rod pair having a longitudinal axis parallel to the length and cross-sectionally centered within the rod pair and having a first end and a second end longitudinally distal from each other, the rod pair being peripherally twisted by the apparatus about the longitudinal axis throughout substantially the entire length of the rod pair such that the inner rod can still frictionally slide into and out of the outer rod, the apparatus comprising:

a motor;

a gear head connected to the motor;

a rotatable first chuck connected to the gear head for engaging the first end of the rod pair;

a substantially non-rotatable second chuck aligned with the first chuck and positioned a distance from the first chuck in accordance with the length of the rod pair, the second chuck engaging the second end of the rod pair;

a linear thruster connected to the second chuck for reciprocating motion between a first position and a second position, the motion being in alignment with the first and second chucks to permit loading and unloading of the rod pair and to permit engagement of each chuck with a respective end of the rod pair; and a safety sensor for sensing the proper engagement of the rod pair ends by the first and second chucks before allowing the motor to activate.

32. An apparatus for twisting a hollow, open-seam rod, the rod having a length, a longitudinal axis parallel to the length and cross-sectionally centered within the rod, and first and second ends longitudinally distal from each other, the rod being peripherally twisted by the apparatus about the longitudinal axis throughout substantially the entire length of the rod, the apparatus comprising:

a stepper motor;

a gear head connected to the stepper motor;

a rotatable first chuck connected to the gear head, the first chuck having a male component and at least one female component for engaging the inside and outside, respectively, of one end of the rod;

a substantially non-rotatable second chuck aligned with the first chuck and positioned a distance from the first chuck in accordance with the length of the rod, the second chuck having a male component and at least one female component for engaging the inside and outside, respectively, of the other end of the rod;

a fixture block connected to the second chuck;

a fixture plate;

a linear thruster connected to the fixture block and mounted to the fixture plate for reciprocating motion between a first position and a second position, the motion being in alignment with the first and second chucks, the first position to permit loading and unloading of the rod and the second position to permit engagement of each chuck with a respective end of the rod; and a logic controller connected to the stepper motor for causing the stepper motor to twist the rod a specified amount.

33. The apparatus of claim 32 wherein the logic controller further causes the stepper motor, after the rod has been twisted, to reverse direction for controllably unwinding the rod until the springback of the rod has been relieved.

34. A method of twisting a pair of hollow, open-seam rods having a first end and a second end longitudinally distal from each other, the rod pair being dimensioned such that the inner rod frictionally slides into and out of the outer rod, the inner rod having a length slightly greater than the outer rod, the rod pair having a longitudinal axis cross-sectionally centered within the rod pair and parallel to the length, the method comprising the steps of:

loading the rod pair onto at least one rod holder;

twisting the rod pair peripherally about the longitudinal axis throughout substantially the entire length of the rod pair such that after twisting the inner rod still frictionally slides into and out of the outer rod; and unloading the rod pair.

35. The method of claim 34 wherein the step of loading further comprises the step of:

automatically aligning the rod pair.

36. The method of claim 34 wherein the step of loading further comprises the step of:

engaging the inside and outside surfaces of each end of the rod pair.

37. The method of claim 36 wherein the step of loading further comprises the steps of:

ensuring that the inside and outside surfaces of each end of the rod pair are properly engaged; and preventing twisting if each end is not properly engaged.

38. The method of claim 34 wherein the step of twisting comprises the steps of:

setting an amount of twist to be performed on the rod pair; and performing the set amount of twist on the rod pair.

39. The method of claim 34 wherein the step of twisting further comprises the step of:

unwinding the rod pair after twisting to controllably relieve springback.

40. The method of claim 34 wherein the step of twisting further comprises the steps of:

unwinding the rod pair after twisting to controllably relieve springback;

sensing when springback has been relieved; and unwinding the rod pair an additional pre-set amount.

41. A method of twisting a hollow, open-seam rod, the rod having a length, a longitudinal axis parallel to the length and cross-sectionally centered within the rod, and first and second ends longitudinally distal from each other, the method comprising the steps of:

setting an amount of twist to be performed on the rod;

loading the rod onto at least one rod holder;

engaging the inside and outside surfaces of each end of the rod;

twisting the rod peripherally about the axis by the set amount throughout substantially the entire length;

unwinding the rod to controllably relieve springback; and unloading the rod.

42. The method of claim 41 wherein the step of loading further comprises the step of:

automatically aligning the rod to ensure proper engagement of the inside and outside surfaces of each end of the rod.

43. The method of claim 41 wherein the step of unwinding further comprises the steps of:

sensing springback; and deactivating the unwind when the sensed springback is substantially relieved.

* * * * *